US007644659B2

(12) United States Patent
Lundin et al.

(10) Patent No.: US 7,644,659 B2
(45) Date of Patent: Jan. 12, 2010

(54) CLEANING APPARATUS FOR CYLINDER SURFACES OF A PRINTING MACHINE AND SPRAY NOZZLE FOR SUCH A CLEANING APPARATUS

(75) Inventors: Kjell E. Lundin, Zwingenberg (DE); Rune G. Vestman, Zwingenberg (DE)

(73) Assignee: Oxy-Dry Maschinen GmbH, Egelsbach (DE)

( * ) Notice: Subject to any disclaimer, the term of this patent is extended or adjusted under 35 U.S.C. 154(b) by 199 days.

(21) Appl. No.: 11/463,441

(22) Filed: Aug. 9, 2006

(65) Prior Publication Data

US 2007/0033764 A1 Feb. 15, 2007

(30) Foreign Application Priority Data

Aug. 10, 2005 (EP) ..... 05017362

(51) Int. Cl.
*B41F 35/00* (2006.01)

(52) U.S. Cl. ..... 101/425; 101/424

(58) Field of Classification Search ..... 101/425, 101/424

See application file for complete search history.

(56) References Cited

U.S. PATENT DOCUMENTS

| | | | | |
|---|---|---|---|---|
| 2,721,764 | A * | 10/1955 | Wilson, Jr. | 239/276 |
| 2,896,865 | A * | 7/1959 | Hamilton | 239/521 |
| 3,976,007 | A * | 8/1976 | Junghans et al. | 101/425 |
| 4,015,307 | A * | 4/1977 | Kossak | 15/256.52 |
| 5,331,891 | A * | 7/1994 | Sugiyama et al. | 101/424 |
| 5,813,087 | A | 9/1998 | Huffman | |
| 6,557,470 | B1 * | 5/2003 | Persson | 101/424 |
| 7,219,605 | B2 * | 5/2007 | Nishiyama et al. | 101/424 |
| 7,363,673 | B2 * | 4/2008 | Schonewille et al. | 15/29 |
| 2002/0157205 | A1 * | 10/2002 | Hara | 15/256.52 |

FOREIGN PATENT DOCUMENTS

| | | |
|---|---|---|
| DE | 4316747 | 8/1994 |
| DE | 29612400 | 10/1996 |
| DE | 19516422 | 11/1996 |
| EP | 1106355 | 6/2001 |
| EP | 0881330 | 11/2002 |
| EP | 1020230 | 12/2004 |
| WO | 9507182 | 3/1995 |

* cited by examiner

*Primary Examiner*—Anthony H. Nguyen
(74) *Attorney, Agent, or Firm*—Volpe and Koenig, P.C.

(57) ABSTRACT

A cleaning device for surfaces of cylinders of a printing machine is provided, having at least one nozzle 23 with a nozzle opening 4 for a jet of cleaning fluid 13, a distribution line 22 for cleaning fluids, in which the nozzle 23 is inserted, as well as a cleaning element 20 for lifting contaminants, dissolved by the cleaning fluids, off the surface of the cylinder. The nozzle 23 is embodied as a separate component and detachably inserted in the distribution line 22. The nozzle 23 is made from a soft-elastic material. The nozzle 23 is provided with a deflector surface 6 arranged downstream from the nozzle opening 4 for deflecting and fanning a jet 13 exiting the nozzle opening 4, as well as a base 1 for inserting it into a distribution line 22, and a channel 11, which extends, on the one side, to a base opening 3 and, on the other side, to the nozzle opening 4. Furthermore, the invention relates to a nozzle for insertion in such a cleaning device.

16 Claims, 3 Drawing Sheets

CLEANING APPARATUS FOR CYLINDER SURFACES OF A PRINTING MACHINE AND SPRAY NOZZLE FOR SUCH A CLEANING APPARATUS

BACKROUND

The invention relates to a cleaning device for the surface of cylinders of a printing machine as well as a nozzle for installation in such a cleaning device. The cleaning device comprises a nozzle with a nozzle opening for a for a jet of cleaning fluid, a distribution line for cleaning fluids, into which the nozzle is inserted, as well as a cleaning element for lifting contaminants dissolved by the cleaning fluid off the surface of the cylinder. In addition to a nozzle opening, the nozzle comprises a base for insertion into the distribution line for cleaning fluids as well as a channel extending, on the one side, to an opening in the base and, on the other side, to the nozzle opening.

For guidance, processing, and for driving printed material sheets or printed material webs in printing machines, an intense contact is necessary between the printed material and the cylinders of the printing machine. Therefore, when paper is used as the printed material, for example, deposits of paper dust (fibers, coat, fillers etc.), ink, and perhaps powder dust develop on the cylinders. These deposits influence the cylinders in their functionality. For printing quality and operational safety as well it is necessary to clear the cylinders of printing machines of contaminants in regular intervals.

This generally occurs via automated cleaning devices, which apply cleaning fluids onto the surfaces of the cylinders to be cleaned and use brushes or cloth as cleaning elements in order to lift contaminants dissolved by the cleaning fluids off the surface of the cylinder. EP 1 106 355 A1 shows an example of such a cleaning device.

When printing paper webs, the regularly required cleaning of the surface of the cylinders of a printing machine must be performed under operating conditions in order to avoid considerable production down times, i.e. during the cleaning process the paper web continues to travel through the printing machine causing discards to develop. In order to keep the time for cleaning the surface of the cylinders as short as possible, usually the cleaning is performed at production speed, producing from 5 to 25 discards per second. Considering costs, it is therefore desirable to apply the cleaning fluids in the most efficient way possible and, in particular, also to ensure the spatial and temporal distribution of the applied cleaning fluid to be as even as possible.

The known cleaning devices are generally provided with a spray pipe, which serves as a distribution line and has a multitude of nozzle openings evenly distributed over its length. Using this spray pipe, the cleaning fluids are then applied on the cleaning element of the cleaning device, e.g., a brush (EP 1 106 355 A1).

However, a spray pipe with nozzle openings is not optimal for the desired spatially and temporally even distribution of the cleaning fluids applied. Generally, a more or less directed jet exits the nozzle openings so that the local distribution of the cleaning fluids varies in the axial direction by the nozzle openings. Therefore, for example brush rolls, onto which the cleaning fluids are sprayed, are provided with an axially oscillating motion and an appropriate adjustment drive for an even axial distribution of the cleaning fluids.

The above-described problem of the required even spatial and temporal Distribution is further enhanced in heat-set printing machines having a dryer, through which the printed material is guided after printing. Here, when cleaning the surface of the cylinders under operational conditions, the printed material carries cleaning fluids into the dryer during the cleaning process. The conventionally used cleaning fluids have a relatively high content of volatile hydrocarbons, which enter the dryer and, through the heat developed, under unfavorable conditions, can reach a flammable concentration when evaporating. Here, it is also essential that excess amounts of cleaning fluid are avoided during the cleaning process. However, an optimal cleaning effect is to be achieved with a cleaning time as short as possible. Thus it is of the utmost importance to apply the cleaning fluids with an efficiency that is as high as possible, which particularly means to design the spatial and temporal distribution of the cleaning fluids applied as evenly as possible.

An effective means to achieve a spatially even distribution of cleaning fluids is the use of nozzles having a deflector surface arranged downstream from the nozzle opening for deflecting and fanning the jet exiting the nozzle opening. This principle is known from other applications, for example the application of pesticides in agriculture. However, until now, it has hardly ever been used in the present field of cleaning devices for printing machines because appropriate nozzles require an installation space usually not available in such cleaning devices. Further, nozzles of this type are still faced with the problem, that the nozzle opening must not be selected too small, as not to become clogged by residue. However, a nozzle opening being too large prevents the desired temporally even distribution of the cleaning fluid applied, as described above, because too much cleaning fluid per time unit can flow through.

SUMMARY

The present invention is therefore based on the object to optimize a cleaning device for the surface of cylinders of a printing machine of the type mentioned at the outset and a nozzle therefore, such that a better spatially and temporally, even distribution of the applied cleaning fluid is possible.

This object is attained in a cleaning device having the features of the invention. Advantageous embodiments and further developments of the cleaning device according to the invention are described below. A nozzle attaining the above-mentioned object is also provided. Preferred further developments of the nozzle are also described below.

According to the present invention, the nozzle with its nozzle opening is embodied as a separate component, with its deflector surface arranged in front of the nozzle opening for deflecting and fanning the jet exiting the nozzle opening, with its base to be inserted into a distribution line for cleaning fluids, and its channel, which, on the one side, extends to an opening in the base and, on the other side, to a nozzle opening, being made from a soft-elastic material, in particular plastic or rubber. This results in several different advantages.

Due to the soft-elastic embodiment of the nozzle, the nozzle opening can be selected very small in order to allow dosing the jet of cleaning fluid more precisely and to design the temporal distribution of the applied cleaning fluid more evenly. Due to the fact that the channel with the nozzle openings is surrounded by an elastic material, which particularly behaves in a flexible manner during an operation with pressure pulses by expanding and contracting again to a small extent, the danger of clogging the nozzle opening with residue from the cleaning fluids is only very slight.

Further, the soft-elastic embodiment of the nozzle allows an easy exchange, by mounting it to the distribution line using its elasticity, for example by pressing it into a corresponding opening. When the nozzle is embodied appropriately small, even a retrofitting of conventional spray pipes is possible. Such a mounting to the distribution line using the elastic features of the nozzle can be considerably supported, here, in that the base of the nozzle is provided with a bead for undercutting an opening in the distribution line. Once this bead is pressed through the opening in the distribution line, the nozzle is held in the opening even against high applied pressures.

Another advantage of the cleaning device and the nozzle according to the invention includes its cost-effective production, with production of the nozzle as a plastic part made as an injection molding being noted.

Thus, the invention provides a novel nozzle as well as a cleaning device having such a nozzle, which can be provided with a very small nozzle opening without increasing the risk of clogging with residues from the cleaning fluids. Even when the nozzle opening is clogged, it creates no serious problem because the nozzle according to the invention can be exchanged for a new one very easily, in seconds, and without the use of any tools.

The assembly of the nozzles according to the invention at the distribution line is facilitated when the nozzle has a base surface, supported on the exterior of the distribution line, which is adjusted thereto. Simultaneously, this results in an automatically correct alignment of the nozzle opening and the deflector surface; a crooked installation of the nozzle is prevented by the base surface. This imminent protection from a crooked installation is further improved when the nozzle is designed such that the nozzle opening is integrated in the base surface.

The unavoidable formation of mist during the spraying of cleaning fluids can be avoided in the nozzle according to the invention when a jet guidance area extends from the nozzle opening to the deflector surface so that the jet can flow along a bent surface. The jet then does not hit the deflector surface head-on but is constantly deflected and thus fanned out.

Beneficially, the deflector surface is advantageously provided with a drop-off edge at its side facing away from the nozzle opening, in order to ensure a defined formation and direction of motion of the fanned jet. By its very nature, the length L of the deflector surface, defined by the position of the drop-off edge, influences the level of fanning of the jet as well as its speed. Therefore the nozzle according to the invention can be optimized for its respective use by the optimal selection of the position of the tear-off edge. When the length L is selected small, the jet is slowed to a lesser extent, and simultaneously less fanned. When L is selected large, the jet is fanned wider, simultaneously lengthening the distanced over which the jet is slowed along the deflector surface, so that the speed of the jet is considerably reduced.

Finally, the nozzle according to the invention can be provided with a protective plate arranged recessed behind the drop-off edge.

BRIEF DESCRIPTION OF THE DRAWINGS

In the following, an exemplary embodiment for a cleaning device and an exemplary embodiment for a nozzle according to the invention are described and explained in greater detail using the attached drawings. They show.

DETAILED DESCRIPTION OF THE PREFERRED EMBODIMENTS

Figure 1:
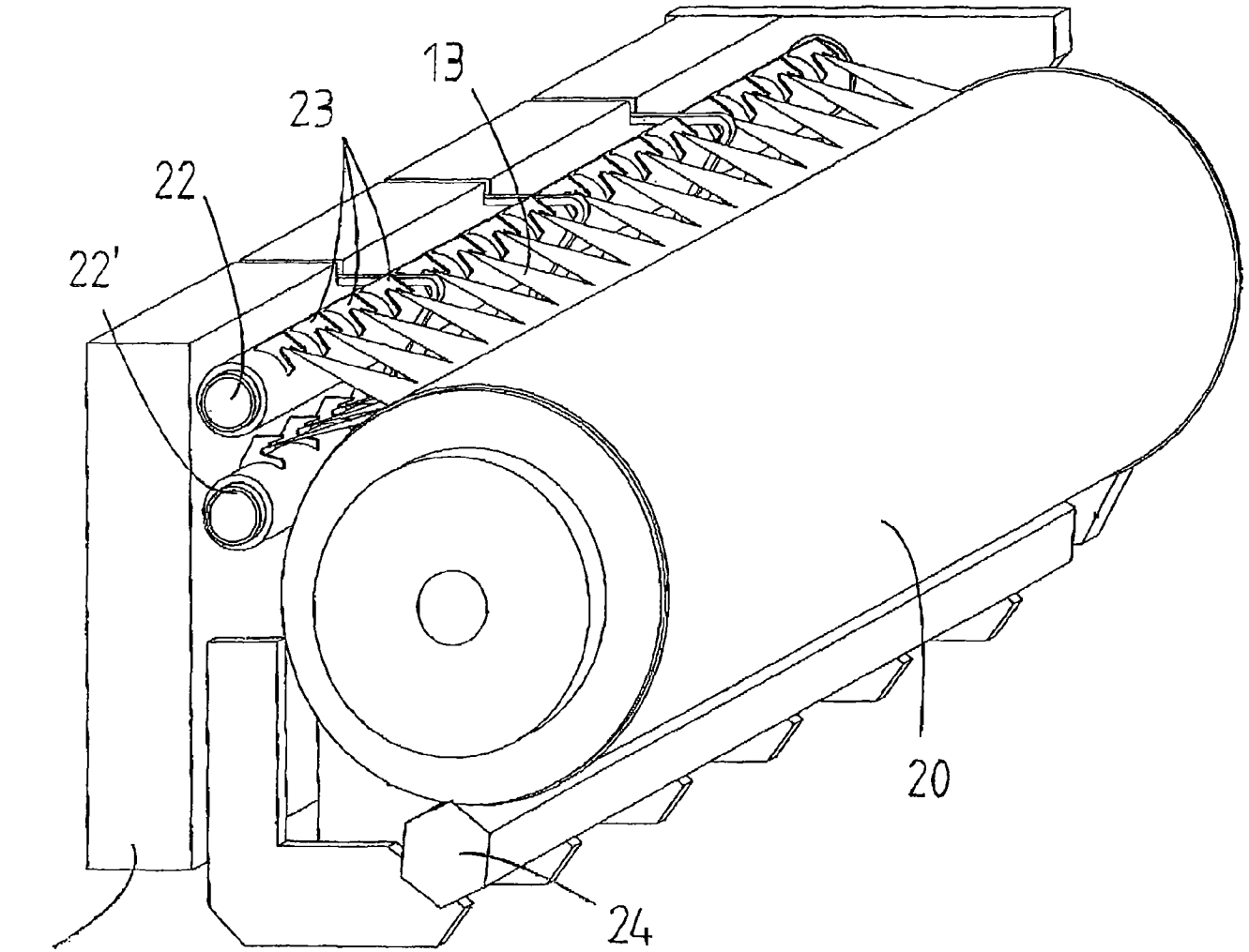
FIG. 1: a perspective view of the exemplary embodiment of a cleaning device.

FIG. 1 shows an exemplary embodiment of a cleaning device according to the present invention. For lifting contaminants off the surface of the cylinder (not shown) of a printing machine this cleaning device comprises a cleaning brush 20, held to a frame 21 and spinning around its longitudinal axis. At the frame 21, two distribution lines 22, 22' for cleaning fluids are arranged, with the distribution line 22 guiding a solvent and the other distribution line 22' guiding water. A number of openings are provided over the length of the distribution lines 22, 22', into each of which a nozzle 23 according to the invention is inserted. Each of these nozzles 23 sprays a jet 13 of cleaning fluid to the cleaning brush 20 in order to wet it with the cleaning fluid. The cleaning brush 20 spins clockwise in the present view so that the area of the cleaning brush 20 wetted with cleaning fluid contacts the surface of the cylinder (not shown), where contaminants are diluted and lifted off by the cleaning brush 22. During the further progression of the rotational motion of the cleaning brush 20, its surface passes a scraper 24, at which the lifted contaminants and the residual cleaning fluid are scraped off the cleaning brush 20.

Figure 2:
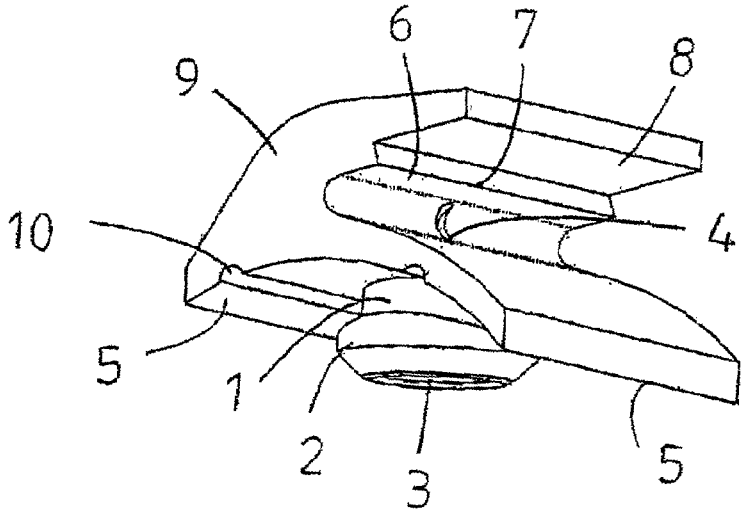
FIG. 2: a perspective view of an exemplary embodiment of a nozzle.

The nozzle 23 shown in FIG. 2 is provided with a base 1 and a bead 2 for gripping behind an opening in a distribution line 22 and with a base opening 3, a nozzle opening 4, not directly visible here, being integrated in a base surface 5 which is adapted to a surface of the cylindrical distribution line 22. In front of the nozzle opening 4, a deflector surface 6 is arranged for deflecting and fanning a jet exiting the nozzle opening 4. This deflector surface 6 is limited by the drop-off edge 7. A protective plate 8 is provided, arranged recessed behind the drop-off edge 7, to avoid, among other things, the formation of mist.

The nozzle is entirely comprised of a soft-elastic material, here injection-molded plastic, and is embodied such that the base surface 5, the deflector surface 6, and the protective plate 8 together form a widened nozzle body 9, by which the nozzle (its dimensions being in the range of 10 millimeters) can better held and, if necessary, be manually pressed into the opening of the distribution line 22 provided therefore.

The base surface 5 has two grooves 10 in order to increase its mobility and to ensure a better contact to the cylindrical surface of the distribution line 22.

Figure 3:
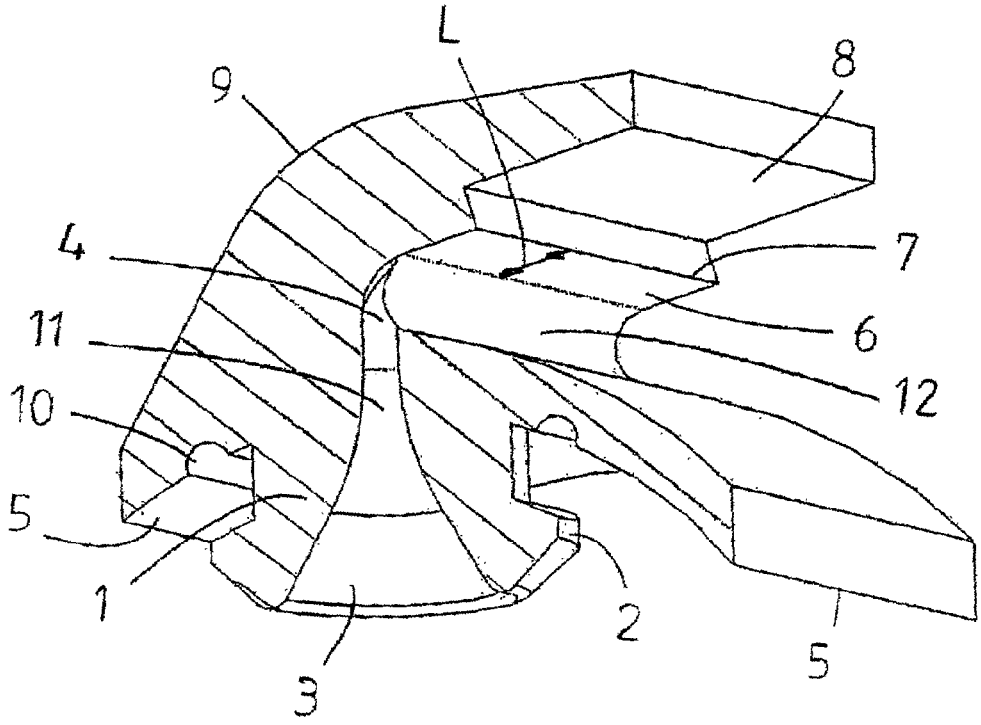
FIG. 3: the same view of a nozzle, shown in cross-section.

In FIG. 3, which is a cross-sectional representation according to FIG. 2, the progression of a channel 11 is discernible between the base opening 3 and the nozzle opening 4. The channel 11 is formed in the soft-elastic material of the nozzle such that its environment elastically expands and contracts, in particular under pressure pulses occurring, so that the channel wall during the operation of the nozzle, in particular when pulsed jets are used, are constantly in motion. This prevents the channel 11 and, in particular, the nozzle opening 4 from clogging with residue.

Additionally, in FIG. 3 it is clearly discernible that the nozzle opening 4 is arranged in the center of a curved jet guidance area 12 so that the jet flowing through the channel 11 and exiting the nozzle opening 4 flows along the jet guidance area 12, is gradually deflected by it and guided to the deflector surface 6. This avoids eddying and misting of the liquid and the jet guidance occurs in a more defined manner than when the jet were to hit the deflector surface 6 without any deflection by the jet guidance area 12. The length L of the deflector surface 6 to the drop-off edge 7, as described above, is largely responsible for the speed of the jet leaving the drop-off edge 7, because it is slowed more or less depending on the length L, as well as for the degree of fanning of the jet. The area of the drop-off edge 7 is shielded from external disturbances by the protective plate 8.

Figure 4:
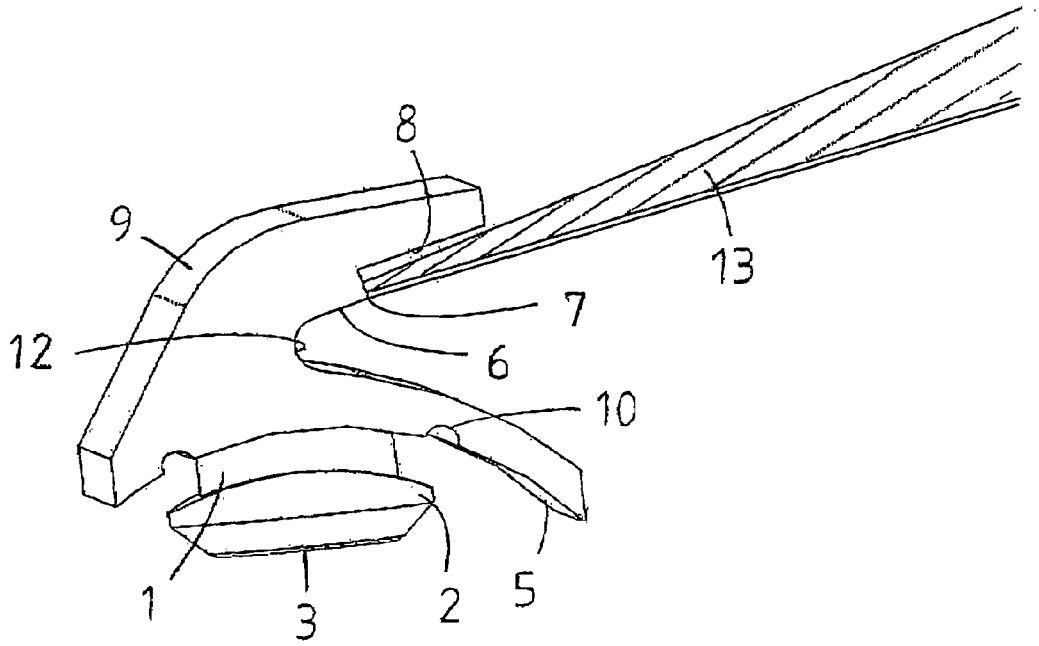
FIG. 4: another perspective view of the nozzle, including a jet.

The representation according to FIG. 4 shows a fanned jet 13, exiting the drop-off edge 7 of the present jet in a defined manner. Otherwise, the components of the nozzle are provided with the same reference characters as in the FIGS. 2 and 3, so that reference can be made to the description of these two figures.

The invention claimed is:

1. A cleaning device for surfaces of cylinders of a printing machine, comprising a plurality of nozzles (23), each having a nozzle opening (4) for a jet of cleaning fluid (13), a distribution line (22) for cleaning fluids having a plurality of openings defined in a sidewall thereof, into which the nozzles (23) are inserted, a cleaning element (20) for lifting contaminants, dissolved by the cleaning fluids, off the surface of a cylinder, the nozzles (23) each being defined as a separate component and are detachably inserted into the distribution line (22), the nozzles (23) being made from a soft-plastic material, and the nozzles (23) each having a deflector surface (6), arranged thereon downstream from the nozzle opening (4), for deflecting and fanning a jet (13) exiting the nozzle opening, and including an elastic base (1) inserted into the openings in the distribution line (22) and a channel (11) which is elastically expandable in response to pressure pulses of the cleaning fluid extends, on one side, to a base opening (3) and, on the other side, to the nozzle opening (4).

2. A cleaning device according to claim 1, wherein the nozzle is a plastic injection molded part.

3. A cleaning device according to claim 1, wherein the base (1) of the nozzle (23) is provided with a bead (2) for engaging behind an opening in the distribution line (22).

4. A cleaning device according to claim 1, wherein the nozzle (23) is provided with a base surface (5) adapted to an exterior surface of the distribution line (22) and supported thereupon.

5. A cleaning device according to claim 4, wherein the nozzle opening (4) is integrated in the base surface (5).

6. A cleaning device according to claim 1, wherein the deflector surface (6) of the nozzle (23) is provided with a drop-off edge (7) for the fanned jet (13).

7. A cleaning device according to claim 6, wherein a protective plate (8) is arranged recessed in a jet direction behind the drop-off edge (7).

8. A cleaning device according to claim 1, wherein a jet guiding area (12) extends from the nozzle opening (4) to the deflector surface (6) in an area of the nozzle.

9. A nozzle for the installation in a cleaning device for surfaces of cylinders of a printing machine, having a nozzle opening (4), a deflector surface (6) arranged downstream from the nozzle opening (4) for deflecting and fanning a jet (13) exiting the nozzle opening (4), a base (1) for inserting into a distribution line for cleaning fluids, and a channel (11), extending, on the one side, from a base opening (3) to, on the other side, the nozzle opening (4), and the nozzle is made from a soft-plastic material so that the channel is elastically expandable in response to pressure pulses in a fluid medium being dispensed.

10. A nozzle according to claim 9, wherein the nozzle is an injection-molded plastic part from plastic.

11. A nozzle according to claim 9, wherein the base (1) is provided with a bead (2) for engaging behind an opening in a distribution line.

12. A nozzle according to claim 9, wherein the nozzle is provided with a base surface (5) adapted to an exterior surface of the distribution line and supported thereon.

13. A nozzle according to claim 12, wherein the nozzle opening (4) is integrated in the base surface (5).

14. A nozzle according to claim 9, wherein the deflector surface (6) is provided with a drop-off edge (7) for the fanned jet (13).

15. A nozzle according to claim 14 wherein a protective plate (8) is arranged recessed in a jet direction behind the drop-off edge (7).

16. A nozzle according to claim 9, wherein a jet guidance area (12) extends from the nozzle opening (4) to the deflector surface (6).

* * * * *